US006889518B2

(12) United States Patent
Lane et al.

(10) Patent No.: US 6,889,518 B2
(45) Date of Patent: May 10, 2005

(54) SERVICE CASE

(75) Inventors: Mark Lane, Acworth, GA (US); Michael B. Davidson, Mississauga (CA); Yakov Arshansky, Conyers, GA (US); David K. Hinde, Rex, GA (US); Richard N. Walker, Monroe, GA (US)

(73) Assignee: Delaware Capital Formation, Inc., Wilmington, DE (US)

( * ) Notice: Subject to any disclaimer, the term of this patent is extended or adjusted under 35 U.S.C. 154(b) by 43 days.

(21) Appl. No.: 10/223,759

(22) Filed: Aug. 19, 2002

(65) Prior Publication Data

US 2003/0037559 A1 Feb. 27, 2003

Related U.S. Application Data

(60) Provisional application No. 60/314,196, filed on Aug. 22, 2001.

(51) Int. Cl.[7] ..... F25D 17/02
(52) U.S. Cl. ..... 62/276; 62/436
(58) Field of Search ..... 62/276, 246, 255, 62/434, 435

(56) References Cited

U.S. PATENT DOCUMENTS

| | | | | |
|---|---|---|---|---|
| 1,980,688 A | | 11/1934 | Lewis | |
| 2,282,342 A | | 5/1942 | Preble | |
| 2,328,189 A | | 8/1943 | Brace et al. | 62/99 |
| 2,379,885 A | | 7/1945 | Davis | 62/89.5 |
| 3,848,426 A | * | 11/1974 | Whitney | 62/255 |
| 4,489,995 A | * | 12/1984 | Barr | 312/236 |
| 4,633,677 A | * | 1/1987 | Maehara | 62/256 |
| 4,782,666 A | * | 11/1988 | Costan | 62/248 |
| 4,829,776 A | * | 5/1989 | Casanova | 62/125 |
| 4,949,554 A | * | 8/1990 | Branz et al. | 62/248 |
| 4,984,435 A | | 1/1991 | Seino et al. | |
| 5,046,320 A | * | 9/1991 | Loose et al. | 62/77 |
| 5,293,902 A | * | 3/1994 | Lapierie | 137/614.04 |
| 5,357,767 A | * | 10/1994 | Roberts | 62/256 |
| 5,381,670 A | | 1/1995 | Tippmann et al. | |
| 5,502,979 A | * | 4/1996 | Renard | 62/256 |
| 5,706,883 A | | 1/1998 | Ward | |
| 5,727,393 A | | 3/1998 | Mahmoudzadeh | 62/81 |
| 5,819,549 A | | 10/1998 | Sherwood | |
| 5,887,440 A | | 3/1999 | Dube | 62/82 |
| 5,895,111 A | | 4/1999 | Santosuosso et al. | |
| 5,911,744 A | | 6/1999 | Kawaguchi | |
| 5,921,096 A | | 7/1999 | Warren | |
| 5,941,083 A | | 8/1999 | Sada et al. | |
| 5,970,734 A | * | 10/1999 | Stillwell et al. | 62/235 |
| 6,155,075 A | | 12/2000 | Hanson et al. | 62/512 |
| 6,182,459 B1 | | 2/2001 | Hertel | |
| 6,185,951 B1 | | 2/2001 | Lane et al. | |
| 6,273,276 B1 | | 8/2001 | Upton et al. | |
| 6,351,964 B1 | | 3/2002 | Brancheau et al. | |
| RE37,630 E | | 4/2002 | Behr | |
| 6,381,972 B1 | | 5/2002 | Cotter | |
| 6,412,296 B1 | | 7/2002 | Rossi | |

FOREIGN PATENT DOCUMENTS

EP 000916291 A1 * 5/1999

* cited by examiner

*Primary Examiner*—William E. Tapolcai
*Assistant Examiner*—Mohammad M. Ali
(74) *Attorney, Agent, or Firm*—Foley & Lardner LLP

(57) ABSTRACT

A temperature controlled service case for storage and display of chilled or frozen products, including at least one compartment for product storage, at least one access opening providing entrance to the compartment, at least one shelf within the compartment for holding product, and refrigeration operatively associated with the compartment for maintaining a selected temperature therein. The refrigeration includes at least one cooling coil above the shelf with a cooling medium flowing therethrough, and cooling within the shelf with a cooling medium flowing therethrough. Coolant supply is also provided for supplying cooling medium to the cooling coil and shelf.

51 Claims, 1 Drawing Sheet

SERVICE CASE

CROSS-REFERENCE TO RELATED APPLICATION

This application claims the benefit of U.S. Provisional Application Ser. No. 60/314,196, filed Aug. 22, 2001.

BACKGROUND OF THE INVENTION

The present invention relates to a temperature controlled case for storage and display of chilled and/or frozen products, especially in a store environment.

A typical cooling coil in a refrigerated case is constructed of metal, such as copper or aluminum. Since this material is metal, it is quite noticeable when mounted in a refrigerated case. Case manufacturers try to conceal this coil by placing an attractive cover over the coil or placing the coil in a hidden location, as under the product shelf. However, although these methods hide the coil, they do not make the case particularly attractive and may affect refrigeration efficiency.

Refrigeration case shelving is generally made from painted metal or stainless steel. This type of shelving may be used to cover a forced air evaporator mounted beneath the shelf, or there may be a gravity feed coil mounted above the shelving. However, the main purpose of the shelving is to hold and display the product within the refrigerated case. Therefore, in both of the foregoing applications, the actual cooling of the product is achieved from the gravity feed coil mounted above the shelf or from the forced air coil mounted below the shelf, which is not entirely satisfactory.

Therefore, it is a principal object of the present invention to provide an improved, temperature controlled case for storage and display of cooled and/or frozen products.

It is a further object of the present invention to provide a case as aforesaid which is efficient and at the same time esthetically pleasing.

It is an additional object of the present invention to provide a case as aforesaid which may be readily and effectively used in a commercial store environment.

It is a further object of the present invention to provide a coolant service case with coolant means above and below product storage.

It is a still further object of the present invention to provide a coolant service case as aforesaid with coolant means above the product and coolant means beneath the product, including coolant gravity coils and gravity louvers above the product and refrigerated pans beneath the product.

Further objects and advantages of the present invention will appear hereinbelow.

SUMMARY OF THE INVENTION

In accordance with the present invention, the foregoing objects and advantages are readily obtained.

The present invention provides a temperature controlled case for storage and display of chilled and/or frozen products. The coolant service case of the present invention includes coolant means above the product and coolant means beneath the product. The coolant means above the product desirably includes coolant gravity coils and gravity louvers with drains and preferably lighting included therein. The coolant means beneath the product desirably includes refrigerated pans for holding product, which pans are desirably insulated on their underside.

Further features and advantages of the present invention will appear hereinbelow.

BRIEF DESCRIPTION OF THE DRAWING

The present invention will be more readily understandable from a consideration of the following illustrative drawing, wherein.

DETAILED DESCRIPTION OF PREFERRED EMBODIMENTS

Figure 1:
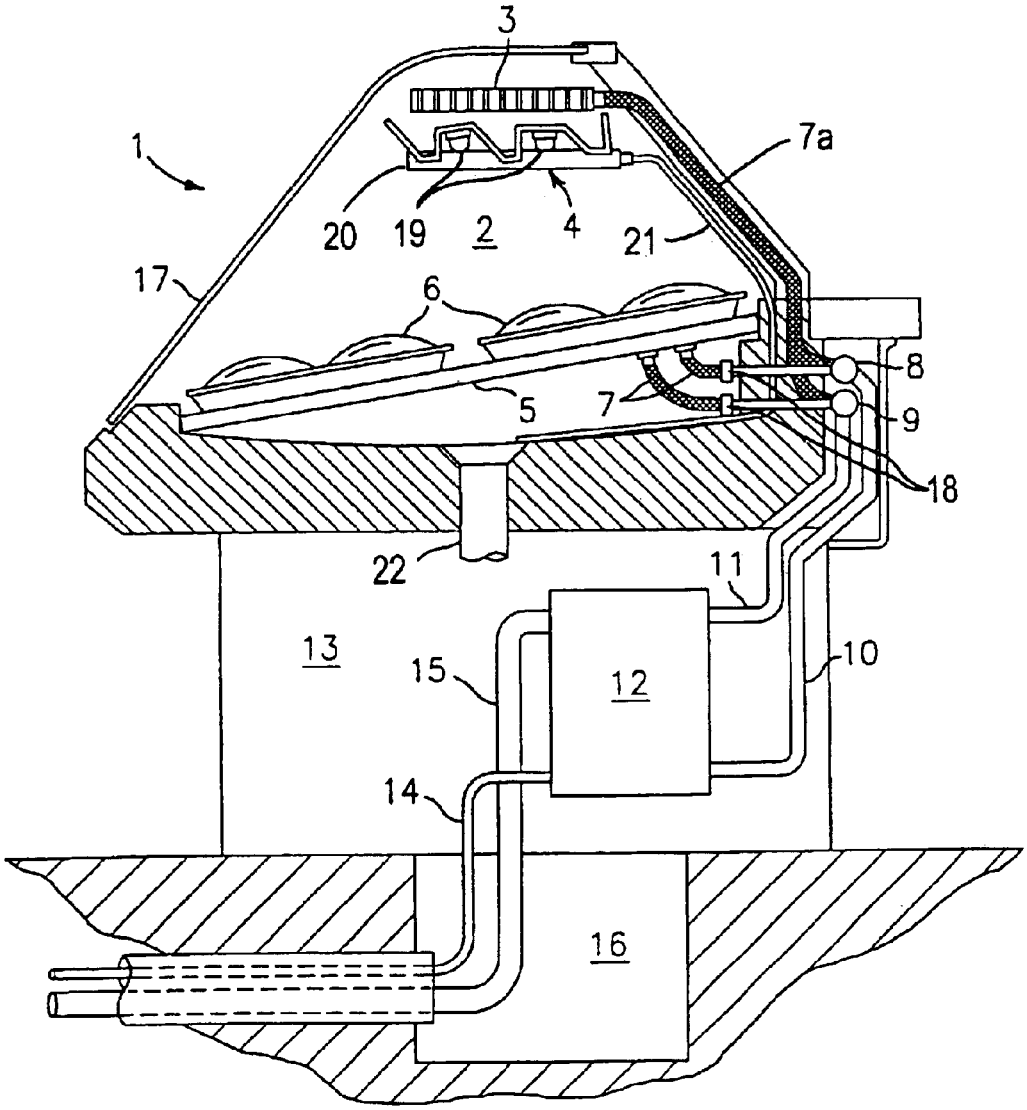
FIG. 1 is a cross-sectional view of the coolant service case of the present invention.

FIG. 1 shows a cross-section of the secondary coolant service gravity case (1). The secondary coolant gravity coil (3) is situated near the top of the refrigerated space (2). Mounted below the coil is a gravity louver assembly (4) which is designed to both direct air flow through the refrigerated spice and catch water falling from the coil above from condensation or melted during defrost cycles. A drain pan (20) directs the flow of water from the louvers into piping (21) connected to the main case drain (22). The louver assembly may also contain an integrated lighting system (19) to better illuminate the product.

Secondary coolant is also circulated through channels inside refrigerated pans (5) which provide additional cooling. The pans may be insulated on their underside to prevent heat transfer to the unused space below. Above the pans, the products (6) are placed in containers made of a metallic or otherwise heat-conductive material. The secondary coolant flows to and from the refrigerated pans and coil inside of flexible hoses (7) and **(7*a*) which may be equipped with valved quick-disconnect fittings (18)** to facilitate removal of the pan for cleaning or other maintenance.

Supply (8) and return (9) headers are placed preferably in the back of the case for connection to the refrigerated coils and pans. Chilled secondary coolant flows into the supply header through the secondary coolant supply line (10) and coolant flows out of the return header through a secondary coolant return line (11), both of which may either be connected to a packaged chiller (12) or a centralized chiller for multiple cases or the entire facility.

The packaged chiller consists of a pump to provide flow of coolant and a heat exchanger to provide heat flow from the secondary coolant to a primary coolant, preferably a volatile refrigerant. Additional equipment may also be included to facilitate temperature controls, safety devices, and to provide defrost of the coils and pans.

The chiller is preferably contained within a pedestal base (13) to be hidden from view of the customer. In some situations where a direct expansion system already exists within a store, a refrigerant liquid line (14) and suction line (15) can provide flow of a primary refrigerant to the packaged chiller, possibly through a refrigeration pit (16) already existing in the floor.

In a conventional manner, the coolant service case of the present invention includes an openable door 17 for access to stored products.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A system for storage and display of chilled or frozen products comprising:

a case defining a space for storing the products;

a first cooling system having a first coolant;

a second cooling system having a second coolant;

a coil adapted to receive the second coolant for cooling the products;

a louver disposed beneath the coil;

a pan adapted to receive the second coolant for cooling the products;

a first header and a second header adapted to route the second coolant;

wherein the first coolant is configured to cool the second coolant.

2. The system of claim 1 wherein the first cooling system is a primary refrigeration system and the first coolant is a volatile refrigerant.

3. The system of claim 2 wherein the second cooling system is a secondary cooling system and the coolant is a secondary coolant.

4. The system of claim 3 further comprising a chiller adapted to transfer heat from the second coolant to the volatile refrigerant.

5. The system of claim 4 wherein the chiller further comprises a pump and a heat exchanger.

6. The system of claim 5, wherein the chiller is located in a base.

7. The system of claim 6 wherein the base is a pedestal of the case.

8. The system of claim 4 wherein the first cooling system is at least partially routed through a floor to the chiller.

9. The system of claim 1 wherein the first header is a supply header and the second header is return header.

10. The system of claim 9 wherein the supply header is adapted to provide a coolant supply flow to the coil and the pan.

11. The system of claim 9 wherein the return header is adapted to provide a coolant return flow from the coil and the pan.

12. The system of claim 9 wherein the supply header and the return header are located in a back portion of the case.

13. The system of claim 1 wherein the coil is a secondary coolant gravity coil.

14. The system of claim 13 wherein the gravity coil is located near a top portion of the space.

15. The system of claim 1 wherein the louver is configured to direct air flow using gravity.

16. The system of claim 1 wherein the louver is configured to direct air flow through the space.

17. The system of claim 1 wherein the louver is configured to catch water from the coil during a defrost cycle.

18. The system of claim 1 wherein the louver is coupled to a lighting system.

19. The system of claim 1 wherein the pan is configured to circulate a flow of the secondary coolant.

20. The system of claim 19 wherein the pan is located beneath the products.

21. The system of claim 20 wherein the products are provided in one or more containers made of a heat conductive material.

22. The system of claim 20 wherein the pan is configured to receive a flow of the second coolant therethrough.

23. The system of claim 20 wherein the pan is at least partially insulated.

24. The system of claim 19 wherein the pan further comprises at least one flexible hose for routing the second coolant to and from the pan.

25. The system of claim 24 wherein the flexible hose further comprises one or more valved quick-disconnect fittings.

26. The system of claim 1 further comprising a door for access to the products in the space.

27. A system for cooling products, comprising:

a case defining a space for storage of the products;

coil above the space and configured to cool the products;

an assembly beneath the oil configured to direct air flow and catch water;

a pan below the space and configured to cool the products;

means for cooling a coolant adapted to flow to the gravity coil and the pan; and a first header and a second header adapted to route the coolant.

28. The system of claim 27 wherein the assembly is a louver assembly is configured for directing air flow within the space.

29. The system of claim 27 further comprising means for removing the pan.

30. The system of claim 27 further comprising means for routing a flow of the coolant to the gravity coil and the pan.

31. The system of claim 27 further comprising means for providing a refrigerant configure to exchange heat with the coolant.

32. The system of claim 27 further comprising means for routing a flow of the coolant from the coil and the pan.

33. The system of claim 27 further comprising means for illuminating the space so that visibility of the products is enhanced.

34. A service case having a space for storing and displaying chilled or frozen products, comprising: a secondary coolant system for circulating a coolant through at least one of a coil and a pan, a heat exchanger adapted to transfer a quantity of heat from the coolant to a primary refrigeration system, a louver device disposed within the space and configured to direct air flow within the service case, and a first header and a second header adapted to route the coolant.

35. The service case of claim 34 wherein the primary refrigeration system is an existing direct expansion system in a store.

36. The service case of claim 34 wherein the pan is configured to support the products.

37. The service case of claim 36 further comprising at least one flexible hose and a quick-disconnect fitting adapted to permit removal of the pan.

38. The service case of claim 34 wherein a storage space for the products is provided above the pan and beneath the coil.

39. The service case of claim 34 further comprising an openable door for access to the products.

40. The service case of claim 34 wherein the louver device is configured to catch water from the coil and to illuminate the products.

41. A method of providing a temperature controlled case for chilling or freezing products configured for storage and display in a space comprising:

providing a secondary coolant gravity coil in the space and configured above the products;

positioning a louver beneath the secondary coolant gravity coil;

providing a pan in the space and configured below the products;

coupling the secondary coolant gravity coil and the pan to a secondary coolant system;

providing a chiller communicating with the secondary coolant system and a primary coolant system, adapted to provide a heat flow from the secondary coolant system to the primary coolant system;

wherein the secondary coolant system further comprises a first header and a second header adapted to route a secondary coolant in the secondary coolant system.

42. The method of claim 41 wherein the chiller further comprises a pump and a heat exchanger.

43. The method of claim 42 wherein the chiller is located in a base of the temperature controlled case.

44. The method of claim 42 further comprising coupling the primary coolant system to the chiller.

45. The method of claim 44 wherein the primary coolant system is an existing direct expansion system in a store.

46. The method of claim 45 wherein the primary coolant system is a primary refrigeration system.

47. The method of claim 41 wherein the pan has a channel configured to communicate with the secondary coolant system.

48. The m hod of claim 47 further comprising at least one flexible hose interconnecting the pan and the secondary coolant system.

49. Them method of claim 48 further comprising at least one quick-disconnect fitting coupled to the flexible hose and adapted to permit removal of the pan.

50. The method of claim 41 wherein the first header and the second header are positioned in a back portion of the temperature controlled case.

51. The method of claim 41 further comprising providing equipment adapted for temperature control.

* * * * *

UNITED STATES PATENT AND TRADEMARK OFFICE

CERTIFICATE OF CORRECTION

PATENT NO. : 6,889,518 B2
DATED : May 10, 2005
INVENTOR(S) : Mark Lane et al.

It is certified that error appears in the above-identified patent and that said Letters Patent is hereby corrected as shown below:

Column 4,
Line 8, before “coil” please insert -- a gravity --.
Line 9, please replace “oil” with -- coil --.
Line 24, please replace “configure” with -- configured --.

Column 6,
Line 4, please replace “m hod” with -- method --.
Line 7, please replace “Them” with -- The --.

Signed and Sealed this

Eighteenth Day of October, 2005

JON W. DUDAS
*Director of the United States Patent and Trademark Office*